US007409802B2

(12) United States Patent
Fiedler

(10) Patent No.: US 7,409,802 B2
(45) Date of Patent: Aug. 12, 2008

(54) FLOOR STRIP FOR BRIDGING A JOIN BETWEEN TWO FLOOR COVERINGS

(76) Inventor: Karl-Heinz Fiedler, Liesenfelder Strasse 19, D-56281 Emmelshausen (DE)

( * ) Notice: Subject to any disclaimer, the term of this patent is extended or adjusted under 35 U.S.C. 154(b) by 46 days.

(21) Appl. No.: 11/649,933

(22) Filed: Jan. 5, 2007

(65) Prior Publication Data

US 2007/0175147 A1 Aug. 2, 2007

(30) Foreign Application Priority Data

Jan. 11, 2006 (DE) ..... 20 2006 000 428 U

(51) Int. Cl.

| | |
|---|---|
| ***E04B 1/62*** | (2006.01) |
| ***E04B 1/68*** | (2006.01) |
| ***E04B 2/00*** | (2006.01) |
| ***E04F 14/15*** | (2006.01) |
| ***E04F 15/22*** | (2006.01) |
| ***E04F 15/14*** | (2006.01) |
| ***E04C 3/00*** | (2006.01) |
| ***E04D 1/36*** | (2006.01) |

(52) U.S. Cl. ..... 52/466; 52/287.1; 52/396.04; 52/468; 52/461; 52/463

(58) Field of Classification Search ..... 52/466, 52/211, 212, 204.54, 208, 716.8, 459–464, 52/468, 584.1, 775, 287.1, 396.04, 396.05, 52/395

See application file for complete search history.

(56) References Cited

U.S. PATENT DOCUMENTS

| | | | | |
|---|---|---|---|---|
| 3,570,205 | A * | 3/1971 | Payne | 52/466 |
| 4,067,155 | A * | 1/1978 | Ruff et al. | 52/105 |
| 6,588,165 | B1 * | 7/2003 | Wright | 52/506.05 |
| 6,647,680 | B2 * | 11/2003 | Daly et al. | 52/287.1 |
| 6,729,092 | B2 * | 5/2004 | Grosjean | 52/395 |
| 2002/0000072 | A1 * | 1/2002 | McGrath et al. | 52/466 |
| 2002/0050109 | A1 * | 5/2002 | Grosjean | 52/393 |
| 2002/0095895 | A1 * | 7/2002 | Daly et al. | 52/464 |
| 2003/0051426 | A1 * | 3/2003 | Kornfalt | 52/396.1 |
| 2006/0201093 | A1 * | 9/2006 | Stanchfield | 52/459 |
| 2006/0260241 | A1 * | 11/2006 | Stanchfield | 52/459 |

FOREIGN PATENT DOCUMENTS

| | | |
|---|---|---|
| DE | 201 17 167 | 2/2002 |
| DE | 203 20 273 | 10/2004 |

* cited by examiner

*Primary Examiner*—Robert Canfield
*Assistant Examiner*—Hunter M Dreidame
(74) *Attorney, Agent, or Firm*—Collard & Roe, P.C.

(57) ABSTRACT

A floor strip for bridging a join between two floor coverings that border on one another comprises a base profile that can be fixed in place on the floor, two upwardly extending shanks molded on the base profile, and a cover profile having at least one cover wing that projects laterally. There is a downwardly directed crosspiece, which is connected with the base profile by way of an articulation. The articulation is formed by an articulation rail that is rounded on both sides and grasped between the shanks of the base profile. The shanks are upright but rounded on the inside. The articulation rail is formed by a solid material or by a sleeve, which has a longitudinal groove, into which the crosspiece and/or an attachment means that engages through the cover profile passes. In certain sections, the longitudinal groove passes completely through the articulation rail, and the crosspiece of the cover profile has a greater depth in these regions.

11 Claims, 4 Drawing Sheets

FLOOR STRIP FOR BRIDGING A JOIN BETWEEN TWO FLOOR COVERINGS

BACKGROUND OF THE INVENTION

1. Field of the Invention

The innovation relates to a floor strip for bridging a join between two floor coverings that border on one another.

2. The Prior Art

A floor profile arrangement is shown in German Patent No. DE 201 17 167 U1, in which a base profile having two upright shanks accommodates a cover profile that engages over the two upright shanks with two crosspieces, so as to be adjustable in height. In order to bridge greater heights, the crosspieces are configured to be somewhat longer on the underside of the cover profile. In order to equalize excess lengths when pushing the floor profile and the cover profile together, depressions or perforations are provided in the side arms of the floor profile, which accommodate the excess lengths. Pivoting of the cover profile in the case of floor coverings having different thickness is not possible.

Another floor profile arrangement is shown in German Patent No. DE 203 20 273 U1, in which an articulation is provided on a base profile. An upright connecting part having a drive channel is held in the articulation in an articulated manner. A cover profile engages over the connecting part with two crosspieces molded onto its underside. The crosspieces form the guide, and the cover profile is fixed in place in the drive channel with screws that engage from above. In order to be able to pivot the cover profile even when the crosspieces have been pushed far over the floor profile, lateral recesses have been provided in the floor shank(s) of the floor profile, and, at the same time, the crosspieces have been shortened at the other locations, so that they offer the side guide only in partial regions. The crosspieces that are dually set onto the cover profile require broad joins between the adjacent floor coverings, particularly if two coverings having different thickness border on one another, and the cover profile has to be greatly inclined. Because of the low point of rotation and the crosspieces that stand far apart from one another, the cover profile is greatly displaced laterally when it is pivoted, and in many instances, the floor covering is not grasped sufficiently, so that the base profile has to be loosened and re-attached to the floor after it has been moved.

SUMMARY OF THE INVENTION

It is therefore an object of the invention to equalize great height differences in floor coverings having a different thickness, with a cover profile held in an articulated manner relative to the base profile, without any bump, and to hold the coverings together as tightly as possible.

This object is accomplished by a floor strip for bridging a join between two floor coverings that border on one another, comprising a base profile that can be fixed in place on the floor, two upwardly extending shanks molded on the base profile, and a cover profile having at least one cover wing that projects laterally. There is a downwardly directed crosspiece, which is connected with the base profile by way of an articulation. The articulation is formed by an articulation rail that is rounded on both sides and grasped between the shanks of the base profile. The shanks are upright but rounded on the inside. The articulation rail is formed by a solid material or by a sleeve, which has a longitudinal groove, into which the crosspiece and/or an attachment means that engages through the cover profile passes. In certain sections, the longitudinal groove passes completely through the articulation rail to form perforations, and the crosspiece of the cover profile has a greater depth in these regions.

Via the groove in the articulation rail, which passes all the way through, the crosspiece of the cover profile can be introduced further, specifically directly through the center of the articulation. As a result, the cover profile comes to rest lower on the floor covering, because the crosspiece does not get stuck in the articulation rail, but rather passes through all the way to the floor profile. During pivoting, the crosspiece that passes through the center of the articulation rail has the advantage that the join region between the adjacent coverings can be made narrow. Because of passing centrally through the articulation rail, the cover profile is hardly displaced laterally at all during pivoting, so that the floor coverings are sufficiently grasped in every slanted position, and the join is covered.

Even greater equalization of the height difference can be achieved if the base profile is provided with recesses that pass through it, under the section-wise perforations of the articulation rail. The depth region for inserting the crosspiece of the cover profile is increased even further with the recesses in the base profile below the continuous groove through the articulation rail. If one was previously able to utilize ¾ of the region of the diameter of the articulation rail as a holding or guiding part for the crosspiece to be inserted, and therefore several cover profiles having crosspieces of different lengths were required for floor coverings having different thickness, it has now become possible to equalize significantly greater difference ranges with one crosspiece length, and in particular, to do so by passing right through the center of the articulation all the way to the floor on which the base profile is fixed in place. The crosspiece cannot be inserted any deeper than that, unless one were to chisel out the floor underneath at these locations.

In order to sufficiently pivot the cover profile in any desired position, so that the floor covering is sufficiently grasped, even if the floor coverings have only a low height and the crosspiece must penetrate deep through the groove, it is advantageous to configure the recesses in the base profile to be so wide that the crosspiece of the cover profile that engages through the articulation rail has a pivoting freedom of 20°. It has been shown that pivoting freedom of 10° toward each side is sufficient for grasping the coverings. Since the articulation rail with its groove is situated directly above the recess of the base profile, the cutout for a pivot of 20° is only slight, so that the base profile is not weakened by this recess. As experiments have shown, it is possible to place even larger cutouts, because they are always provided only in certain sections. Sufficient rigidity remains for the base rail, even if it consists of plastic and not of metal, because it is fixed in place on the floor by means of being glued or screwed down.

In order to equalize the greatest possible height difference with the cover rail, it is practical to make its crosspiece quite long. The correct length for the crosspiece is obtained when the crosspiece of the cover profile has a depth directed downward, in the section region of the recesses that pass through, that reaches all the way to the floor in the lowermost position of the cover profile, so that it sits on the upwardly standing shanks of the base profile. This length can easily be measured, and it guarantees that the crosspiece touches the direct floor in its lowest position, and is not held back by the base profile.

Because the recesses in the articulation rail and the base profile are provided only in certain sections, and therefore have specific lengths, the extended crosspieces must be adapted to these lengths. For safety reasons, it is advantageous if the extended crosspiece of the cover profile that engages through the recess is configured to be shorter in the longitudinal rail direction than each of the lengths of the perforations and recesses provided in certain sections, through the articulation rail and the base profile. The cover profile may shift slightly, in the longitudinal direction, relative to the base profile and/or the articulation rail. Even then, the crosspiece should be able to engage through the recesses, in order to lock the cover profile in place quite low above the floor and grasp the covering.

In order for the cover profile to find sufficient hold in the articulation rail despite its shifting seat, the crosspiece of the cover profile engages through the groove passing through the articulation rail with a slide fit. The cover profile can be pulled out of the articulation rail relatively far, because of the greater depths of the crosspieces, and the crosspiece ends still have sufficient hold in the slide rail because of the seat for slide fit, and do not bend or actually fold over. The crosspieces with the greater depths are only provided in certain sections.

It is advantageous if the articulation rail, when it is configured as a sleeve, has edge ends directed upward on its upper longitudinal groove. An acute-angle toothed rib directed inward, in each instance, is molded on these edge ends as an end piece. The beaded edge on the groove of the sleeve-like articulation rail possesses an extension for holding the crosspiece of the cover profile, because in this way, additional side walls are created, which can rest against the crosspiece on both sides. The toothed rib that is molded on as an end piece holds the inserted crosspiece tightly in place even if it engages between the edge ends only with a slight length. The toothed ribs engage the crosspiece with a firm hold from both sides, at the required height. This can be from the outer end to below the laterally projecting cover wings of the cover profile. Therefore great height equalization is possible with one part.

In order for the seat and the hold of the cover profile to be even better and firmer if the crosspiece is pushed somewhat further into the articulation rail, the articulation rail has an additional toothed rib directed at an inward and downward slant inward on the edge ends, which stand upright, below the end piece. With the second toothed rib that is directed at a slant inward and downward, the crosspiece is grasped twice and therefore has no possibility of coming loose.

It is advantageous if the slanted outer edge ends of the longitudinal groove of the articulation rail serve as a stop at the ends of the shanks of the base profile. The cover profile orients itself, in terms of its slanted position, essentially by supporting its wing edges on the floor covering. As long as the edges have not yet reached the floor covering, it is advantageous if the cover profile does not angle off too greatly, in order to remain in the pivot range when it is set down. Practice has also shown that pivoting of 20° is sufficient for adaptation to the floor coverings having different thickness.

In order for the cover profile to be able to hold itself in the articulation rail with its crosspiece, the crosspiece of the cover profile and the insides of the longitudinal groove in the solid material of the articulation rail are equipped with a surface structure that engage into one another. The surface structure can be a fine graining with which a hold is possible with almost step-free displacement. However, reciprocal furrowing or tooth-provision is also possible, in order to achieve an advantageous hold for the cover profile, which can also be adjusted if it has become loose over time and fixation in place only occurs by way of the surface structure. Since the sleeve-like articulation rail is already equipped with toothed ribs, these have a firm grip on the crosspiece of the cover profile if the crosspiece has a marked surface structure.

Finally, the firm seat for the cover profile is increased in every height position if the surface structure extends on both sides over the entire surface of the crosspiece. An attempt is made, with the innovation, to cover a greater height difference of floor coverings, without using additional parts or actually replacement parts. Consequently, it is advantageous if the crosspiece of the cover profile is as long as possible, thereby can be pulled far out of the groove of the articulation rail, and nevertheless finds sufficient hold in the articulation rail that it also holds the floor covering. On the other hand, it should be possible to push the crosspiece quite deeply through the articulation rail, all the way to the floor, in order to grasp coverings having a thin wall, and to still find sufficient hold in the articulation rail groove even then. This can be achieved if the surface structure extends on both sides over the entire surface of the crosspiece.

BRIEF DESCRIPTION OF THE DRAWINGS

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

DETAILED DESCRIPTION OF THE PREFERRED EMBODIMENT

Figure 1:
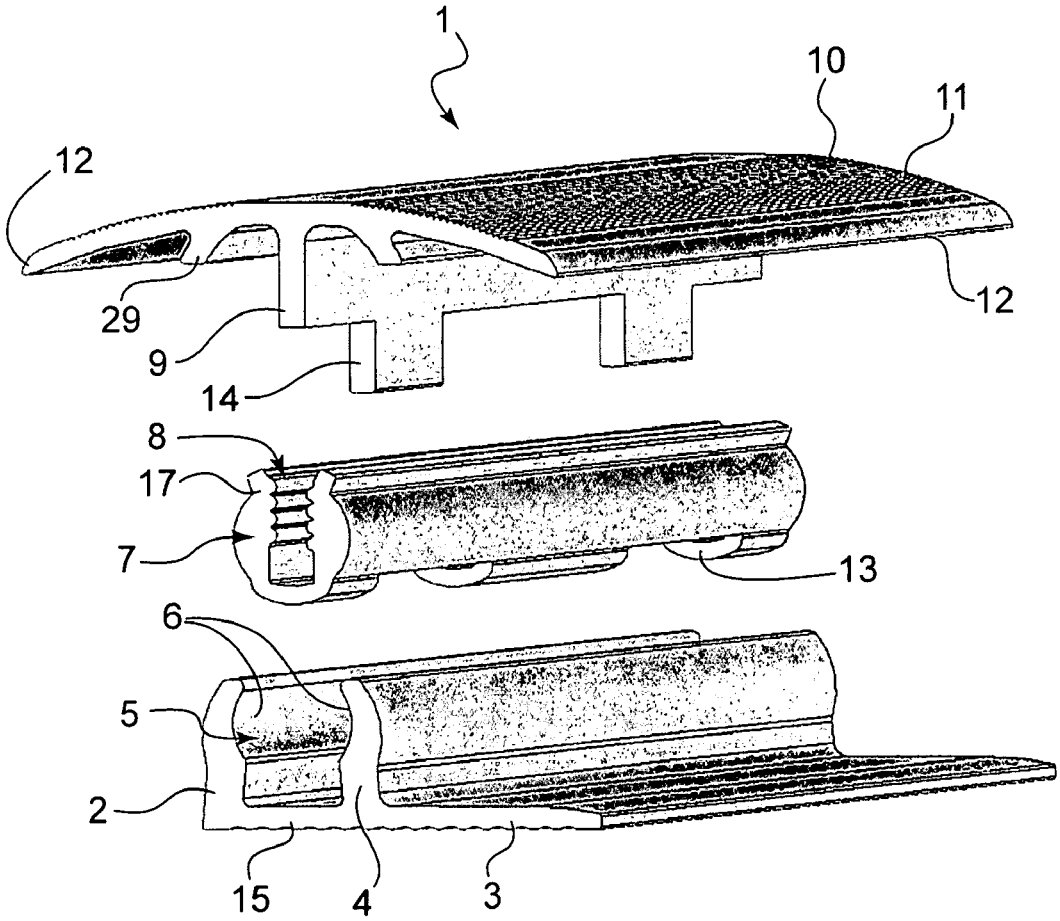
FIG. 1 shows a floor strip that can pivot, pulled apart.

As can be seen in FIG. 1, floor strip 1 consists of a base profile 2, which has a lateral flange 3, with which it is fixed in place on the floor. Furthermore, two shanks 4 that are molded on and are directed upward proceed from base profile 2, which shanks are rounded on the inside and serve as articulation bearings 5. In articulation bearing 5, an articulation rail 7 is held by rounded inside surfaces 6 of shanks 4, so as to rotate. Articulation rail 7 is laterally adapted to the rounded regions of inside surface 6 of shanks 4, and has a groove 8 that is open toward the top, into which a crosspiece 9 of a cover profile 10 engages, which is molded onto the underside of cover profile 10. Cover profile 10 has two lateral wings 11, one of which could be angled away if cover profile 10 is used as an edge delimitation. With the two edges 12, cover profile 10 grasps the floor coverings, not shown, which form a join at the abutment point, which join is bridged by cover profile 10. Crosspiece 9 engages into the groove 8 of articulation rail 7, in order to hold itself or at least to give cover profile 10 a good guide in the vertical direction, when the profile is pressed onto the floor covering.

In order to make it possible for cover profile 10 to be pressed more deeply onto base profile 2, and for crosspiece 9 not to sit on the bottom of groove 8 in articulation rail 7, articulation rail 7 is configured so that groove 8 passes completely through it, in certain sections. The sections that are completely open or cut out are indicated with 13. Crosspiece 9 has extended depths 14 at these perforations 13, which are present in certain sections, which depths are configured to be slightly shorter than section-wise perforations 13, in the longitudinal direction of floor strip 1. In this way, it is guaranteed that extended depths 14 will pass through perforations 13 even if they are slightly displaced in the longitudinal direction. Because of the greater depth 14, crosspieces 9 can be drawn further out of groove 8 and hold thicker floor coverings. Crosspieces 9 nevertheless still find sufficient hold in groove 8.

In order to be able to equalize an even greater height difference, an even greater depth 14 was given to crosspiece 9 in certain sections. For this purpose, base profile 2 was also provided with corresponding cutouts 16, on bottom flange 15, below articulation rail 7, specifically directly below section-wise perforations 13. These cutouts 16 in base profile 2 can be seen in FIG. 2.

Figure 2:
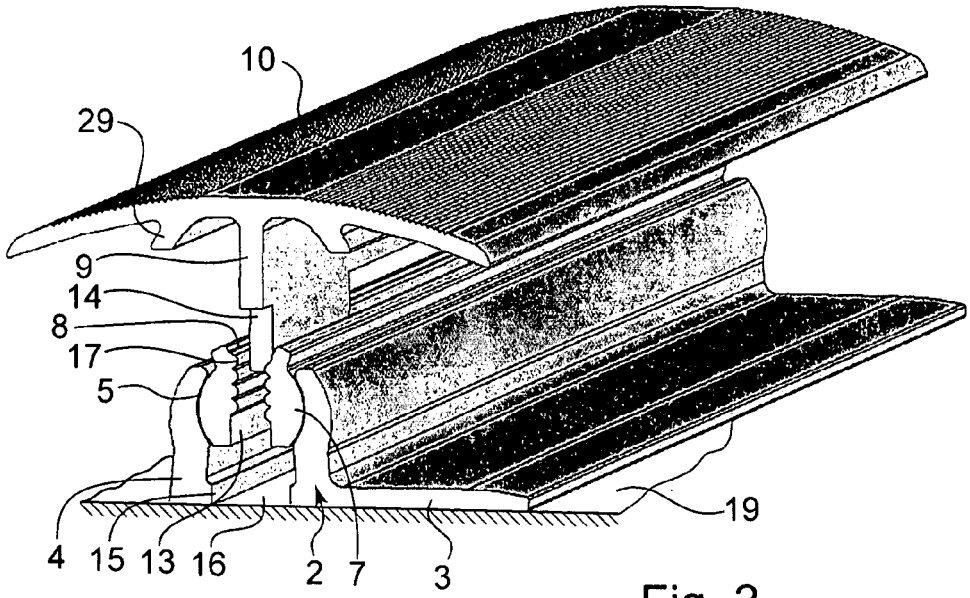
FIG. 2 shows another floor strip, joined together.

In FIG. 2, the crosspiece 9 of cover profile 10 is inserted in the uppermost position, and is held by the last elevation of furrows 17 of groove 8. Since groove 8 of articulation rail 7 is configured as a drive channel having a furrowed or ribbed surface structure 18, a screw, not shown, that passes through cover profile 10 could be provided in addition to crosspiece 9. Crosspiece 9 would have a recess at this point, so that the screw finds sufficient grip in the drive channel. It is important that crosspiece 9 engages centrally through the articulation rail 7 and articulation bearing 5, and furthermore through base profile 2, in order to make the deepest possible depth with crosspiece 9, and remain in the tightest space.

Figure 3:
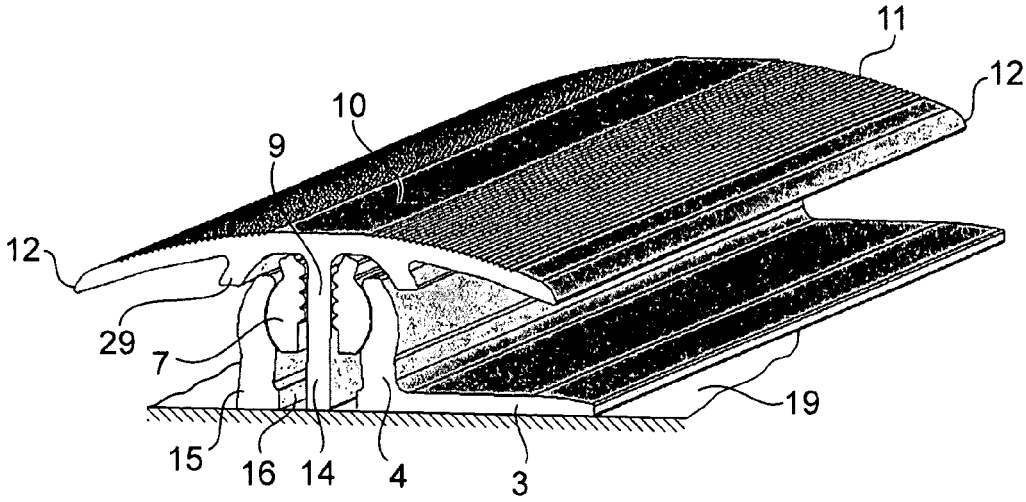
FIG. 3 shows the floor strip, joined together, in a low arrangement.

In FIG. 3, the same floor strip 1 as in FIG. 2 can be seen, but here cover profile 10 is completely pressed down, so that crosspiece 9, with its extended length 14, engages entirely through articulation rail 7 and through cutout 16 of base profile 2, all the way to floor 19. In this position, cover profile 10 sits on top of shanks 4 of base profile 2, which project upward, or on top of top groove edges 20 of articulation rail 7, if these project out of articulation bearing 5. Crosspiece 9 is configured to be so wide that it sits in the groove with a slide fit, with its smooth wall, and can be displaced without resistance. With this configuration, cover profile 10 gets its hold in groove 8, i.e. in the drive channel, from a screw that passes through. Cutout 16 is cut out so wide, in base profile 2, that crosspiece 9, which passes through articulation rail 7, can pivot freely by at least 20° with its extended depth 14, and thereby brings cover profile 10 into the desired slanted position so that it is set down on the floor coverings on both sides with edges 12 of wings 11, and is able to hold them. Cover profile 10 is reinforced with a reinforcement rib 29 on each wing 11, on its underside. This reinforcement rib 29 offers cover profile 10 greater rigidity, even if the wall thickness of wing 11 is only 1.5 mm.

Figure 4:
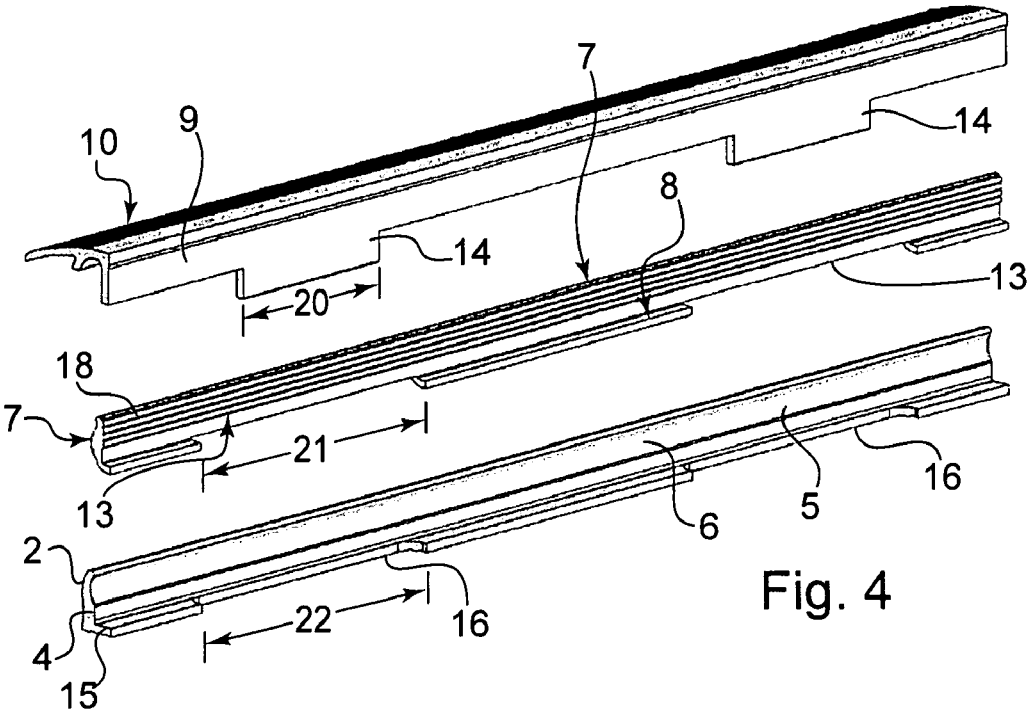
FIG. 4 shows an articulation rail in sleeve form.

In FIG. 4, floor strip 1 is pulled apart, in an exploded view, and additionally cut longitudinally. As a result, it is very easy to see recesses 16 in base profile 2, which are cut out of floor flange 15 in certain sections. Furthermore, one can see the rounded inside surface 6 of articulation bearing 5, which is part of the one shank 4, in which articulation rail 7, shown above it, is mounted. Groove 8 provided in articulation rail 7 has a surface structure 18 of furrows that run longitudinally, in connection with which crosspiece 9 of cover profile 10 slides by when it is inserted into the groove 8. Above recesses 16 of base profile 2, passage perforations 13 of groove 8 are provided in articulation rail 7, through which extended depths 14 engage, which are also provided in certain sections, like perforations 13 and recesses 16. As can be seen, extended depths 14 extend over a shorter section in the longitudinal direction than perforations 13 and recesses 16 that are provided in certain sections, which are essentially disposed one on top of the other. Extended depths 14 are provided to be so long and at sufficient intervals that in the case of the uppermost position according to FIG. 2, cover profile 10, with its crosspiece 9, i.e. its depth 14, still finds sufficient hold in the groove 8 of articulation rail 7.

Figure 5:
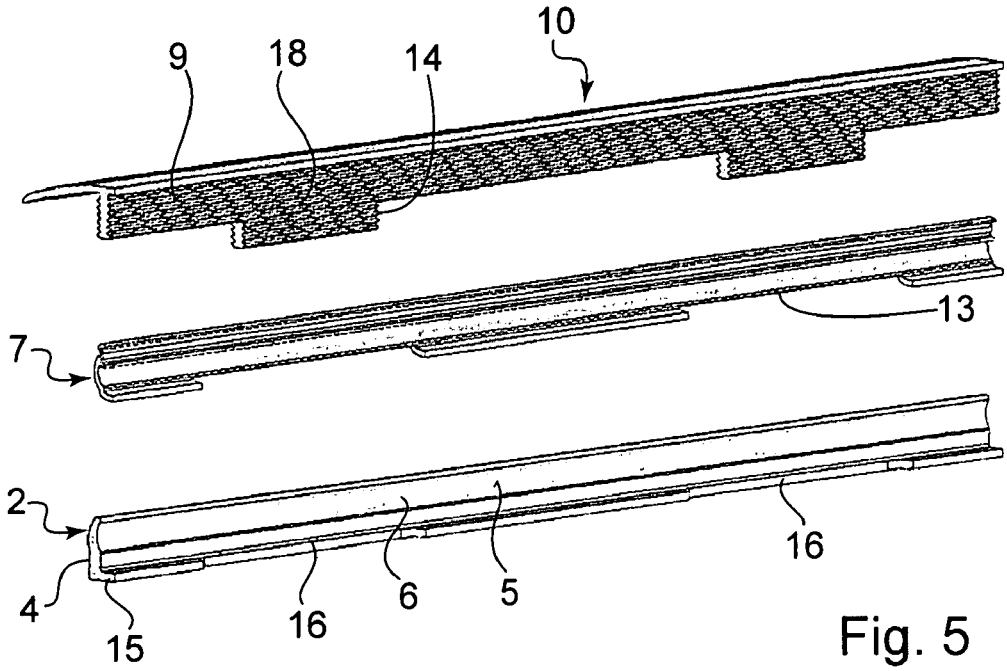
FIG. 5 shows a floor strip cut open from the side, broken down in an exploded view.

As is evident from FIG. 5, crosspiece 9 and its extended depth 14 of cover profile 10 are completely covered with a tooth pattern in the longitudinal direction as surface structure 18. Articulation rail 7 is also configured accordingly; this will be discussed in greater detail in connection with the next figure. In FIG. 5 shows depths 14 that have been molded onto crosspiece 9 in certain sections, and perforations 13 and cutout or recesses 16 that are provided in certain sections of articulation rail 7 disposed below, and base profile 2, shown again below that. Perforations 13 and recesses 16 are provided so that crosspieces 9 can engage completely through the articulation, all the way to floor 19, with their depths 14, in order to thereby lose height if crosspiece 9 nevertheless has a great depth. Depths 14 have a shorter length 20, in the longitudinal direction of the strip, than perforations 13 with their length 21 in articulation rail 7, and recesses 16 with their length 22 in the base profile 2, whereby lengths 21 and 22 are the same.

Figure 6:
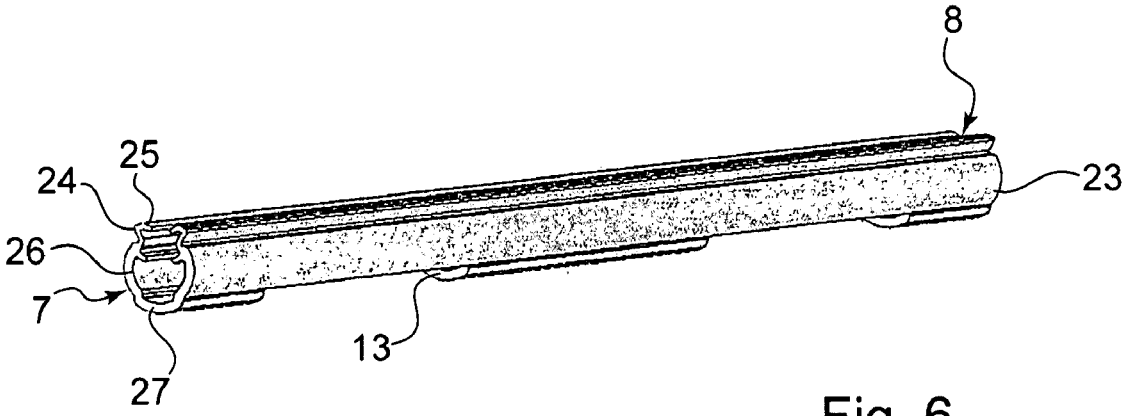
FIG. 6 shows another floor strip.

In FIG. 6, articulation rail 7 is shown as a sleeve, which is preferably produced from plastic having a Shore hardness of approximately 80 to 90. This sleeve shape has the required rounded surfaces 23 on the side, with which it is held in the articulation bearing 5, by inside surfaces 6 of base profile shanks 4, so as to rotate. Toward the top, sleeve-like articulation rail 7 is provided with a slot or a groove 8 for accommodating crosspiece 9 of cover profile 10, edge ends 24 of which are drawn upward. Edge ends 24 have a toothed rib 25, directed into groove 8 as the end piece, which assures sufficient fixation of crosspiece 9. In order to further increase the attachment of crosspiece 9 in articulation rail 7, another toothed rib 26, directed inward, is molded on below toothed rib 25, at a slight distance, like a saw tooth. Lower base 27 of sleeve-like articulation rail 7 is provided with perforations 13, in certain sections, so that depths 14 of crosspiece 9 can pass through without resistance when penetrating deeper, and cover profile 10 loses height.

Figure 7:
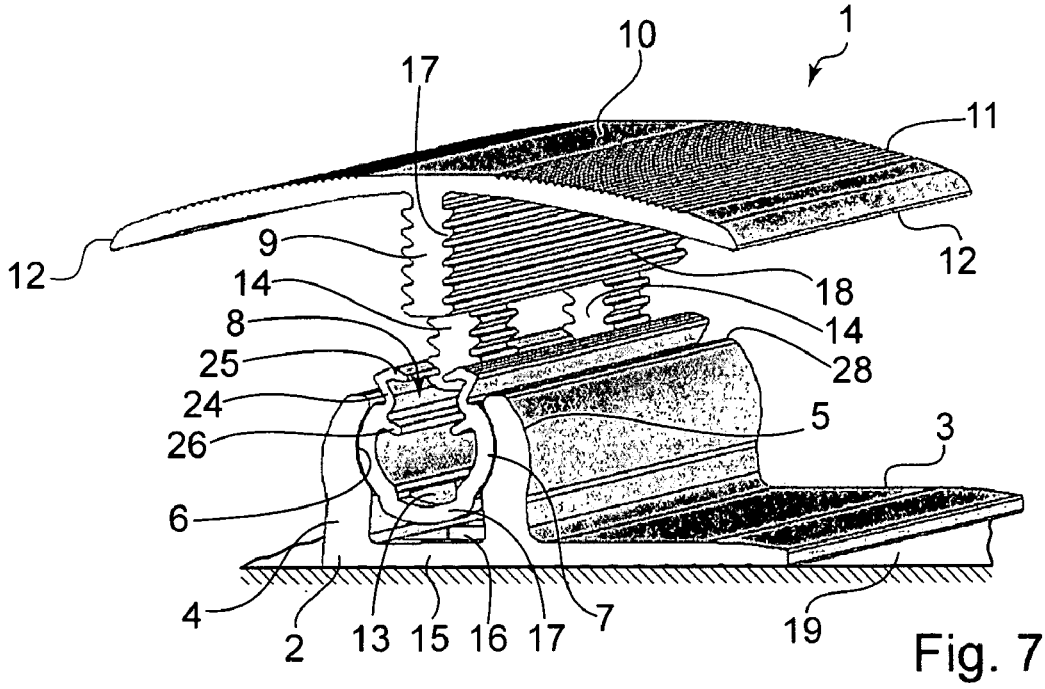
FIG. 7 shows the previous floor strip, pulled apart in an exploded view and cut open from the side.

In FIG. 7, the assembly of a floor strip 1 having a sleeve-like articulation rail 7 can be seen. Base profile 2 is attached to the floor with its side flange 3. Sleeve-like articulation rail 7 is mounted between upright shanks 4 of base profile 2, so as to rotate, and the rail is held in inside surfaces 6 of articulation bearing 5 with its rounded side surfaces. In base profile 2, section-wise cutout 16 in the floor flange 15 is configured to be wider for the pivot range of crosspiece 9. Above cutout 16, perforation 13 for passage of crosspiece 9 or its extended depth 14 is provided in sleeve-like articulation rail 7. Cover profile 10, with its crosspiece 9 formed on the underside, and with depth 14 that is extended in certain sections, is inserted into groove 8 of articulation rail 7. Toothed rib 25 molded onto high-drawn edge end 24 engages into ribbed surface structure 18 of depth 14, and already provides a firm hold. In this position, the greatest hold of cover profile 10 is assured. Cover profile 10 can be pressed down completely, until it sits on the floor coverings, not shown, with its edges 12 of cover wings 11. With floor coverings having different heights, cover profile 10 will pivot with articulation rail 7, until both edges 12 have contact with the floor covering. If the floor covering is very low, crosspiece 9 will penetrate very far into groove 8 of articulation rail 7, and in the bottommost position, depths 14 pass through perforations 13 and cutouts 16 all the way to floor 19, whereby then, the wings come to lie on the upper end 28 of shanks 4. When edge ends 24 of articulation rail groove 8 look out of upright shanks 4 of the base profile, cover profile 10, in its lowermost position, already sits on these edge ends 24, and section-wise depths 14 touch floor 19. In the angled position, the outermost edge end 24 of the longitudinal groove 8 of the articulation rail 7 lays itself against the upper end 18 of the shank 4 of the base profile 2, and utilizes it as a stop.

The innovation is not restricted to the exemplary embodiments disclosed above. Instead, a plurality of variants, modifications, and combinations of individual details described in different embodiments is possible, which also make use of the idea of the invention, and therefore fall within the scope of protection.

LIST OF REFERENCE NUMERALS

| | |
|---|---|
| 1 | floor strip |
| 2 | base profile |
| 3 | side flange |
| 4 | shank |
| 5 | articulation bearing |
| 6 | inside surfaces |
| 7 | articulation rail |
| 8 | groove |
| 9 | crosspiece |
| 10 | cover profile |
| 11 | wing |
| 12 | edge |
| 13 | perforation |
| 14 | extended depth |
| 15 | floor flange |
| 16 | cutout, recess |
| 17 | furrows |
| 18 | surface structure |
| 19 | floor |
| 20 | length of the depth 14 |
| 21 | length of the perforation 13 |
| 22 | length of the recess 16 |
| 23 | rounded surface |
| 24 | edge ends of the groove |
| 25 | toothed rib |
| 26 | toothed rib (saw tooth) |
| 27 | lower base of the articulation rail |
| 28 | shank end |
| 29 | reinforcement rib |

What is claimed is:

1. A floor strip for bridging a join between two floor coverings that border on one another, comprising:

a base profile that can be fixed in place on the floor, two shanks molded on the base profile and extending upward at a distance from one another from the base profile, said shanks each having a rounded inside surface;

a cover profile having at least one cover wing that projects laterally;

a downwardly directed crosspiece connected with the cover profile;

an articulation rail connected to the crosspiece, said articulation rail having a bottom surface and being rounded on both sides and grasped between the shanks of the base profile to connect the crosspiece to the base profile, the articulation rail being formed by a solid material or by a sleeve and which has a longitudinal groove into which the crosspiece or an attachment means that engages through the cover profile passes, wherein the longitudinal groove passes completely through the bottom surface of the articulation rail at least in certain sections to form perforations, and wherein the crosspiece has a greater depth in said perforations than in the rest of the crosspiece.

2. A floor strip according to claim 1, wherein the base profile has recesses that pass through a bottom surface of the base profile under the perforations of the articulation rail.

3. A floor strip according to claim 2, wherein the recesses in the base profile are configured to be so wide that the crosspiece that engages through the articulation rail has a pivoting freedom of 20°.

4. A floor strip according to claim 2, wherein the crosspiece has a downwardly directed depth in an area of the perforations and recesses, which depth reaches to the floor in a lowermost position of the cover profile, in which position the cover profile sits on the shanks of the base profile.

5. A floor strip according to claim 2, wherein a length of the crosspiece in each section that passes through the perforations is configured to be shorter in a longitudinal rail direction than each of the lengths of the perforations and recesses.

6. A floor strip according to claim 1, wherein the crosspiece engages through the groove in the articulation rail with a slide fit.

7. A floor strip according to claim 1, wherein the articulation rail is configured as a sleeve and has edge ends directed upward on an upper part of the groove, on which ends an inwardly directed acute-angle toothed rib is molded on as an end piece.

8. A floor strip according to claim 7, wherein the articulation rail has an additional toothed rib directed at an inward and downward slant inward on the edge ends, which stand upright, below said end piece.

9. A floor strip according to claim 7, wherein the edge ends serve as a stop to ends of the shanks.

10. A floor strip according to claim 1, wherein the articulation rail is configured as a solid piece, and wherein the crosspiece and insides of the longitudinal groove of the articulation rail are each equipped with a surface structure that allows the crosspiece to engage into the articulation rail.

11. A floor strip according to claim 10, wherein the surface structure extends on both sides over the entire surface of the crosspiece.

* * * * *